US009499358B2

(12) United States Patent
Wolf et al.

(10) Patent No.: US 9,499,358 B2
(45) Date of Patent: Nov. 22, 2016

(54) DEVICE FOR COMBINING AN AUXILIARY STACK WITH A MAIN STACK AND SHEET-FED PRINTING PRESS OR SHEET PUNCHING MACHINE HAVING THE DEVICE

(71) Applicant: HEIDELBERGER DRUCKMASCHINEN AG, Heidelberg (DE)

(72) Inventors: Burkhard Wolf, Dossenheim (DE); Andreas Mueller, Heidelberg (DE); Georg Grasmueck, Niederkirchen (DE); Manfred Haeussler, Karlsruhe (DE); Jens Kloss, Leimen (DE); Johannes Schubert, Wiesloch-Baiertal (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/856,784

(22) Filed: Sep. 17, 2015

(65) Prior Publication Data

US 2016/0075528 A1 Mar. 17, 2016

(30) Foreign Application Priority Data

Sep. 17, 2014 (DE) ..... 10 2014 013 687

(51) Int. Cl.
*B65H 1/26* (2006.01)

(52) U.S. Cl.
CPC ..... *B65H 1/263* (2013.01); *B65H 2301/42256* (2013.01); *B65H 2406/34* (2013.01); *B65H 2801/21* (2013.01)

(58) Field of Classification Search
CPC ..... B65H 1/263; B65H 1/26; B65H 2301/42256; B65H 2301/4262; B65H 2301/42622; B65H 2406/34; B65H 3/32; B65H 3/50
USPC ..... 271/218; 414/795.8
See application file for complete search history.

(56) References Cited

U.S. PATENT DOCUMENTS

| | | | | |
|---|---|---|---|---|
| 5,011,126 | A | 4/1991 | Suzuki et al. | |
| 5,110,112 | A | 5/1992 | Henn et al. | |
| 5,131,647 | A | 7/1992 | Henn et al. | |
| 5,803,446 | A | 9/1998 | Leuthold et al. | |
| 5,915,688 | A | 6/1999 | Klenk et al. | |
| 6,286,826 | B1 | 9/2001 | Hummel et al. | |
| 6,481,952 | B2 * | 11/2002 | Deutschle | B65H 31/32 271/211 |

FOREIGN PATENT DOCUMENTS

| | | | | |
|---|---|---|---|---|
| DE | 3937945 | C2 | 9/1991 | |
| DE | 19541792 | A1 | 5/1997 | |
| DE | 19928367 | A1 | 12/2000 | |
| DE | 10151917 | A1 * | 4/2003 | B65H 1/263 |

(Continued)

*Primary Examiner* — Patrick Cicchino
(74) *Attorney, Agent, or Firm* — Laurence A. Greenberg; Werner H. Stemer; Ralph E. Locher

(57) ABSTRACT

A device for combining an auxiliary stack with a main stack includes an auxiliary stack carrier which holds the auxiliary stack and which can be moved out of the stack area for combining the stacks. A holding device firmly holds a lower sheet of the auxiliary stack and an upper sheet of the main stack as the auxiliary stack carrier is moved out of the stack area, in order to maintain a good stack structure. A sheet-fed printing press or sheet punching machine having the device is also provided.

10 Claims, 4 Drawing Sheets

(56) References Cited

FOREIGN PATENT DOCUMENTS

| | | | |
|---|---|---|---|
| DE | 3922803 | B4 | 9/2005 |
| DE | 102005006256 | A1 | 8/2006 |
| DE | 102005019511 | A1 | 11/2006 |
| DE | 102010053587 | A1 | 6/2012 |
| EP | 0450333 | A1 | 10/1991 |
| EP | 0974543 | A1 | 1/2000 |

* cited by examiner

DEVICE FOR COMBINING AN AUXILIARY STACK WITH A MAIN STACK AND SHEET-FED PRINTING PRESS OR SHEET PUNCHING MACHINE HAVING THE DEVICE

CROSS-REFERENCE TO RELATED APPLICATION

This application claims the priority, under 35 U.S.C. §119, of German Patent Application DE 10 2014 013 687.6, filed Sep. 17, 2014; the prior application is herewith incorporated by reference in its entirety.

BACKGROUND OF THE INVENTION

Field of the Invention

The invention relates to a device for combining an auxiliary stack with a main stack in non-stop operation in a feeder of a sheet processing machine. The invention also relates to a sheet-fed printing press or sheet punching machine having the device.

During the combining of an auxiliary stack temporarily held by an auxiliary stack carrier, e.g. a rake, with a main stack, the auxiliary stack carrier has to be drawn out of the stack area again. As a result of the frictional forces between the sheets that are in contact with the auxiliary stack carrier, the sheets can be drawn out of the stack area or form creases, which impede their further processing.

Those sheets then have to be removed manually from the stack area.

German Patent DE 39 22 803 B4, corresponding to U.S. Pat. No. 5,011,126, shows two auxiliary stack carriers which are disposed opposite each other and are formed as a rake, which can be moved laterally into the stack area. As they are drawn out, they are intended to cancel the forces acting on the sheets, so that the latter remain unchanged in their position.

German Patent Application DE 10 2010 053 587 A1 shows an auxiliary stack carrier which has two endless movable belts, which are led around deflection rolls. A relative speed of the belts in relation to the sheets in contact therewith is equal to zero as the auxiliary stack carrier is drawn out of the stack area, so that the sheets remain unchanged in their position.

German Patent Application DE 10 2005 019 511 A1 shows an auxiliary stack carrier having a blown air device which is intended to produce an air cushion, so that a frictional force acting on the sheets as a result of the auxiliary stack carrier is intended to be minimized.

SUMMARY OF THE INVENTION

It is accordingly an object of the invention to provide an alternative device for combining an auxiliary stack with a main stack and a sheet-fed printing press or sheet punching machine having the device, which overcome the hereinafore-mentioned disadvantages of the heretofore-known devices, printing presses and punching machines of this general type and which prevent sheets from carrying sheets with them as an auxiliary stack carrier is drawn out of a stack area.

With the foregoing and other objects in view there is provided, in accordance with the invention, a device for holding an auxiliary stack by using an auxiliary stack carrier for combining the auxiliary stack with a main stack by drawing the auxiliary stack carrier out of a stack area. The auxiliary stack carrier is formed as a rake and a holding device for the bottom sheet of the auxiliary stack and the top sheet of the main stack is provided between at least two rods of the rake. The holding device has at least one suction gripper on its upper side and underside.

It is a particular advantage of the invention that a non-stop stack change is improved in such a way that the change can be carried out reliably without manual intervention. The holding system according to the invention can be introduced simply into the stack area between the rake rods and reliably holds the lower sheets of the auxiliary stack and the upper sheets of the main stack in their desired position as the rake is drawn out of the stack area during the combining of the auxiliary stack with the main stack. According to the invention, the holding system has suction grippers, in particular in the form of suction openings, which fix the sheets to the holding system. It is particularly advantageous if the holder is disposed on the side opposite the rake and then acts on the rear sheet edges.

In a second exemplary embodiment, provision is made for the suction grippers to be disposed on levers and to be mounted in such a way that they can move in the direction of the sheet surfaces in order to fix the latter to the suction grippers while the auxiliary stack carrier is drawn out of the stack area.

With the objects of the invention in view, there is concomitantly provided a sheet-fed printing press or sheet punching machine having the device according to the invention.

Other features which are considered as characteristic for the invention are set forth in the appended claims.

Although the invention is illustrated and described herein as embodied in a device for combining an auxiliary stack with a main stack and a sheet-fed printing press or sheet punching machine having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
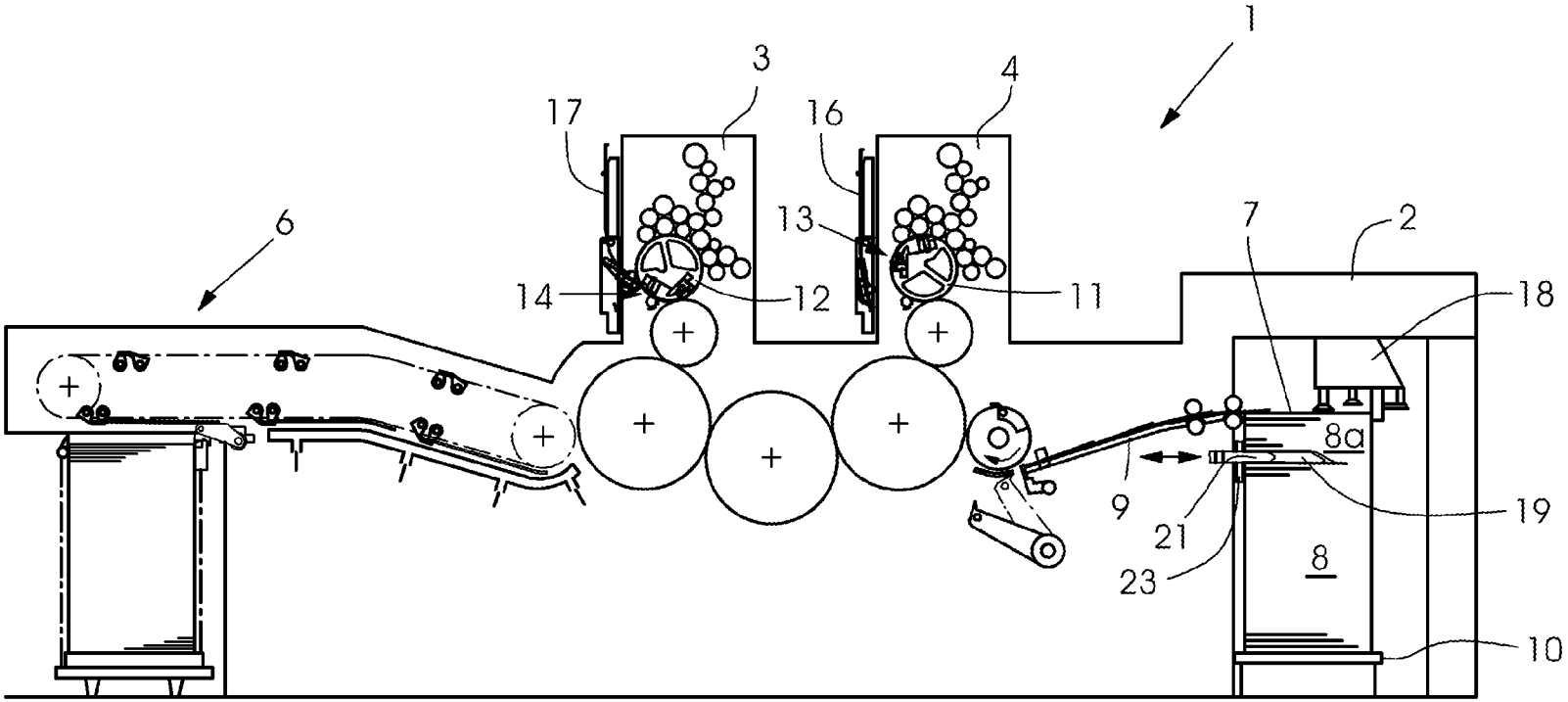
FIG. 1 is a diagrammatic, longitudinal-sectional view of a sheet-fed printing press.

Referring now to the figures of the drawings in detail and first, particularly, to FIG. 1 thereof, there is seen a machine e.g. a punch or a printing press 1 for processing sheets 7, having a feeder 2 and a delivery 6. In the printing press 1, the sheets 7 are taken from a sheet stack 8 of the feeder 2 and are fed, in separated or overlapping form, over a feed table 9 to printing units 3 and 4 that are provided. The printing units 3 and 4 each include a plate cylinder 11, 12, in a known way. The plate cylinders 11 and 12 each have a device 13, 14 for fixing flexible printing plates. Furthermore, each plate cylinder 11, 12 is assigned a device 16, 17 for semi-automatic or fully automatic printing plate changing.

The sheet stack 8 is located on a main stack board 10, which can be raised under control. The sheets 7 are taken from the top of the sheet stack 8 by using a so-called suction head 18 which, inter alia, has at least one suction gripper for the separation of the sheets 7. Furthermore, blowing devices are provided to loosen the upper sheet layers, as are sensing elements for stack tracking. At least one front stack edge stop 23 is provided in order to align the sheet stack 8.

The feeder 2 has a device for non-stop operation, which means that sheets 7 can be delivered continuously even during a stack change. For this purpose, an auxiliary stack carrier 19 is provided, for example in the form of a rake, which holds a virtually processed sheet stack (auxiliary stack 8*a*) until a new main stack 8 is positioned in the feeder 2. The auxiliary stack carrier 19 is drawn out of the stack area, preferably in the sheet processing direction, in order to combine the auxiliary stack 8*a* and new main stack 8.

Figure 2:
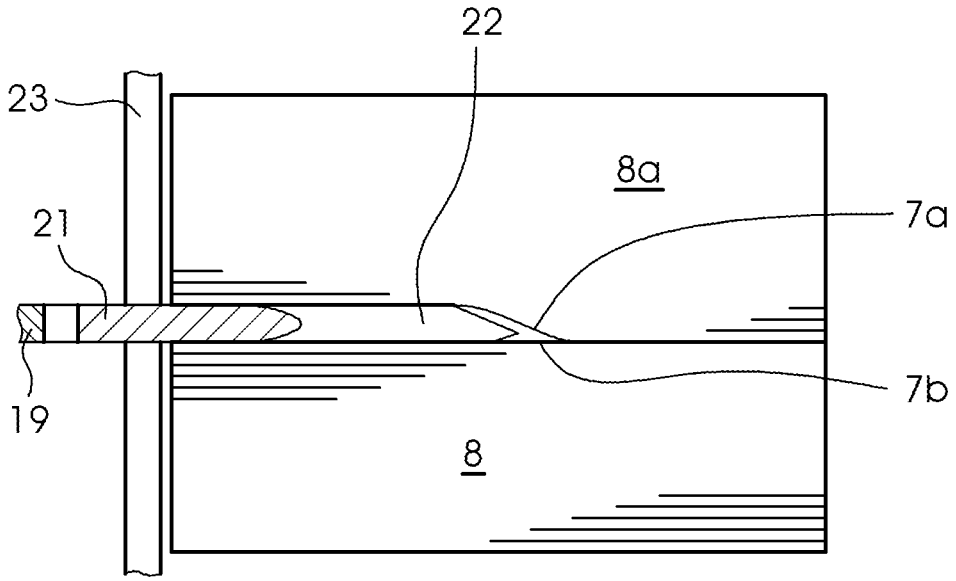
FIG. 2 is an enlarged, fragmentary, vertical-sectional view of a sheet stack with a holder according to the invention.

As is seen in FIG. 2, in order to ensure that a lower sheet 7*a* from the auxiliary stack 8*a* and an upper sheet 7*b* from the main stack 8 which have contact with the auxiliary stack carrier 19 are not drawn out of the stack area together with the latter, a holder 21 is provided, which fixes the sheets in their position during the drawing of the auxiliary stack carrier 19 out of the stack area.

In the exemplary embodiment according to FIG. 2, provision is made to draw out of the stack area a main stack 8 which is partly combined with the auxiliary stack 8*a* and has a rake 19 including a plurality of rake rods 22 disposed beside one another at a distance, while the holder 21, which is disposed between two adjacent rake rods 22, remains in the stack area and fixes the lower sheet 7*a* and the upper sheet 7*b* in their position.

The front stack edge stop 23 serves as an alignment aid for the stacks 8, 8*a* in the sheet processing direction.

Figure 3:
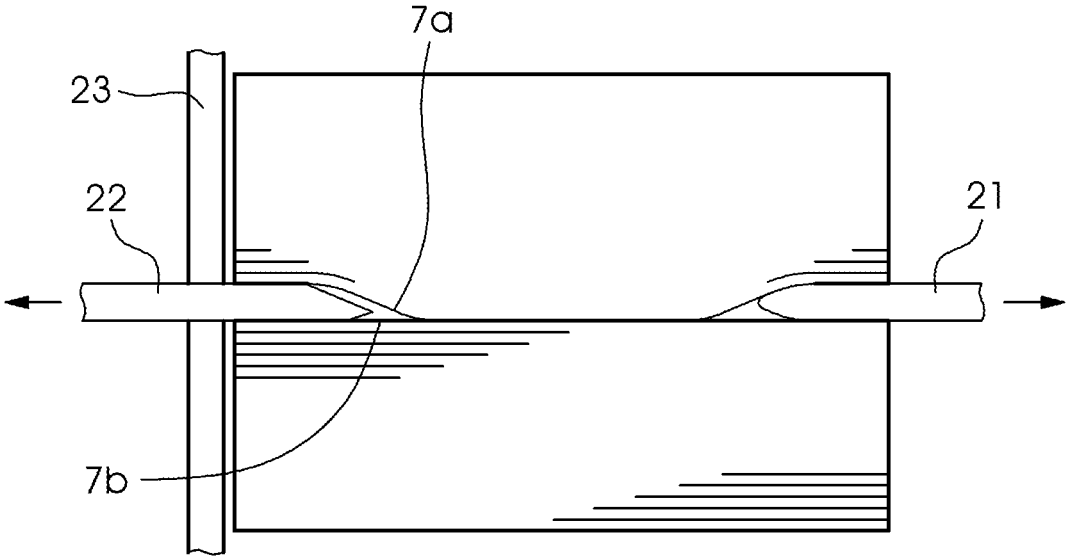
FIG. 3 is a view similar to FIG. 2 of an alternative configuration of the holder.
Figure 4:
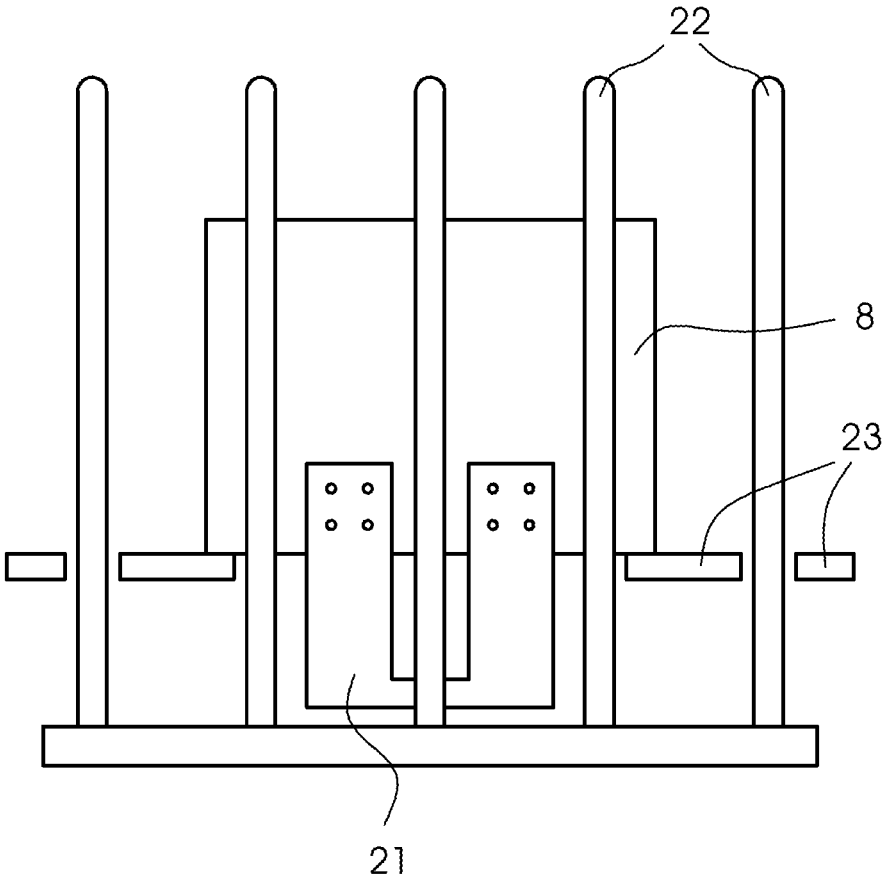
FIG. 4 is a plan view of a rake and the holder.

In an exemplary embodiment according to FIG. 3, provision is made for the holder 21 to be disposed in such a way that the same can be introduced into the stack area from the side opposite to the rake rods 22. As a result of this measure, a holding force can be applied to the sheets 7*a*, 7*b* at the rear edge thereof, which increases the effectiveness of the holding force, in particular when processing thinner sheets. FIG. 4 is a plan view showing the rake 22 and the holder 21.

Figure 5:
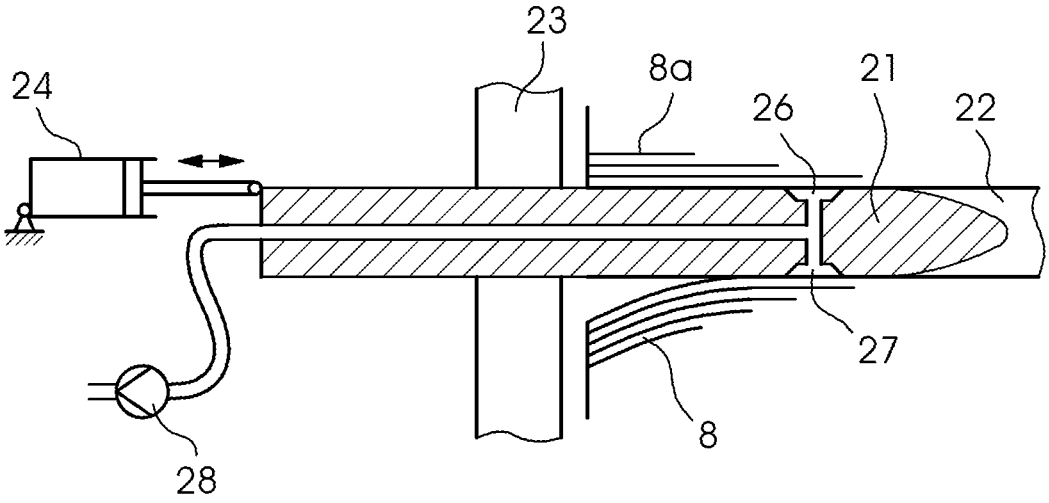
FIG. 5 is a fragmentary, further enlarged, sectional view of the holder with suction grippers.

In an exemplary embodiment according to FIG. 5, the holder 21 has an actuator 24, e.g. in the form of a dual-acting pneumatic cylinder. This effects both the movement of the holder 21 into the stack area and the drawing of the holder 21 out of the stack area. The holder 21 has at least two suction grippers 26, 27 on its upper side and lower side, which are formed as suction openings and to which suction air from a suction source 28 can jointly be applied.

Figure 6:
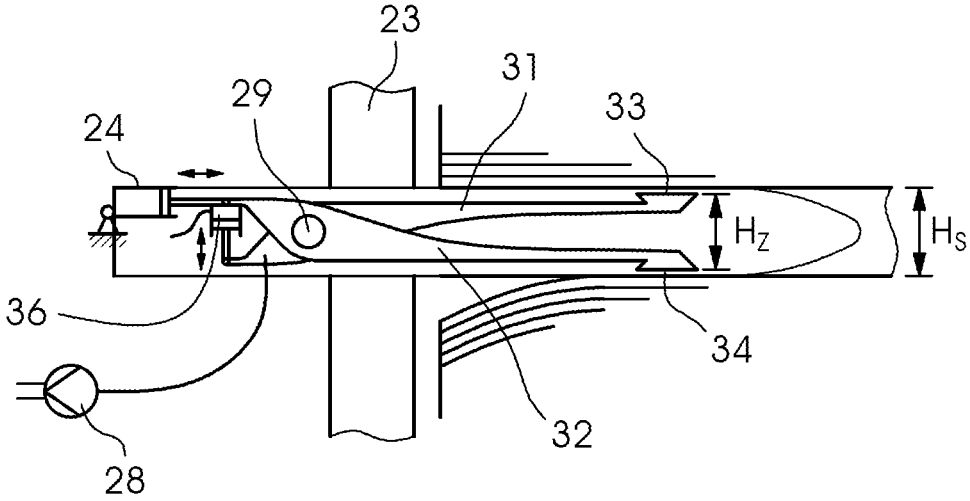
FIG. 6 is a view similar to FIG. 5 of a second exemplary embodiment of the holder.

In an exemplary embodiment according to FIG. 6, provision is made to form the holder 21 as a pair of tongs 37. The tongs 37 substantially include two levers 31, 32 which are crossed at a joint 29 and have suction grippers 33, 34 at their ends, e.g. in the form of suction cups, and can be actuated by using a further actuator 36 in the form of a pneumatic cylinder. In the closed state, the tongs 37 have a height $H_z$ which is smaller than a height $H_s$ of the rake rods 22. In the opened state, the suction grippers 33, 34 are set against the lower and upper sheets 7*a*, 7*b*.

The invention claimed is:

1. A device for combining an auxiliary stack with a main stack in a stack area, the device comprising:

an auxiliary stack carrier configured to hold the auxiliary stack and to be drawn out of the stack area for combining the auxiliary stack with the main stack, said auxiliary stack carrier being formed as a rake having rods; and a holding device disposed between at least two of said rods for holding a bottom sheet of the auxiliary stack and a top sheet of the main stack, said holding device having an upper side with at least one suction gripper and a lower side with at least one suction gripper.

2. The device according to claim 1, wherein said holding device is configured to be positioned between two of said rods of said rake.

3. The device according to claim 1, wherein said suction grippers are formed as suction openings.

4. The device according to claim 1, wherein said suction grippers are formed as suction cups.

5. The device according to claim 4, which further comprises a pair of tongs on which said suction cups are disposed.

6. The device according to claim 5, wherein said rods of said rake have a height, and said tongs have a height smaller than said height of said rods of said rake.

7. The device according to claim 6, which further comprises an actuator for actuating said tongs.

8. The device according to claim 1, which further comprises a suction air source for applying suction air in common to said suction grippers.

9. A sheet-fed printing press, comprising a device according to claim 1.

10. A sheet punching machine, comprising a device according to claim 1.

* * * * *